US007234593B2

(12) United States Patent
Fath et al.

(10) Patent No.: US 7,234,593 B2
(45) Date of Patent: Jun. 26, 2007

(54) CIGARETTE CARTON WITH SEPARABLE PROMOTIONAL SHEET

(75) Inventors: Scott A. Fath, Richmond, VA (US); James D. Evans, Chesterfield, VA (US)

(73) Assignee: Philip Moris USA Inc., Richmond, VA (US)

( * ) Notice: Subject to any disclaimer, the term of this patent is extended or adjusted under 35 U.S.C. 154(b) by 185 days.

(21) Appl. No.: 11/019,577

(22) Filed: Dec. 22, 2004

(65) Prior Publication Data

US 2005/0139496 A1 Jun. 30, 2005

Related U.S. Application Data

(60) Provisional application No. 60/533,144, filed on Dec. 30, 2003, provisional application No. 60/573,803, filed on May 24, 2004.

(51) Int. Cl.
*B65D 85/10* (2006.01)
*B65D 71/00* (2006.01)

(52) U.S. Cl. ..... 206/264; 206/232; 206/271; 206/459.5; 206/831; 229/160.1

(58) Field of Classification Search ..... 206/242, 206/256, 264, 271, 273, 232, 459.5, 831; 40/312; 229/160.1
See application file for complete search history.

(56) References Cited

U.S. PATENT DOCUMENTS 2,158,971 A 5/1939 Stratton
2,888,132 A * 5/1959 Guyer ..... 206/264
3,148,768 A 9/1964 Gatto
3,214,075 A * 10/1965 Champlin et al. ..... 206/459.5
3,219,253 A * 11/1965 Davis ..... 206/831
3,311,281 A * 3/1967 Eisman ..... 206/831
3,536,246 A 10/1970 Rosen
4,103,820 A * 8/1978 Mathison et al. ..... 206/459.5

(Continued)

FOREIGN PATENT DOCUMENTS

EP 0 346 025 12/1989

(Continued)

*Primary Examiner*—Bryon P. Gehman
(74) *Attorney, Agent, or Firm*—Connolly Bove Lodge & Hutz LLP

(57) ABSTRACT

A generally flat carton blank is arranged for assembly into a carton shape holding multiple cigarette packs. The carton blank has a defined periphery, and a generally flat promotional sheet overlies the carton blank within the outer periphery thereof. A portion of the promotional sheet is adhesively secured to the carton blank. In another embodiment a generally flat promotional sheet overlies the carton blank essentially within the outer periphery thereof. Both carton blank each with its associated promotional sheet may then be assembled and loaded with cigarette packs utilizing standard assembly machinery and standard procedures. Fold lines on the carton blank and the promotional sheet facilitate assembly of the carton blank into a carton shape with the promotional sheet inside the assembled carton. In one embodiment, the remaining portion of the promotional sheet is folded into the form of a packaging sleeve holding multiple cigarette packs for retail distribution upon removal of the sleeve and cigarette packs from the carton. In another embodiment of the present invention, the remaining portion of the promotional sheet simply comprises a planar carton insert for ultimate use by the consumer in obtaining rebates, merchandise and the like or when the promotional sheet is simply used for printed matter.

2 Claims, 9 Drawing Sheets

U.S. PATENT DOCUMENTS 4,620,664 A * 11/1986 Kaufman et al. ..... 206/459.5
4,631,900 A 12/1986 Mattei et al.
4,738,359 A 4/1988 Phillips, Jr.
4,784,261 A 11/1988 Kutchin
4,932,534 A * 6/1990 Focke et al. ..... 206/273
5,158,178 A * 10/1992 Cobler ..... 206/256
5,193,328 A 3/1993 Boriani et al.
5,201,413 A * 4/1993 DeBlasio et al. ..... 206/256
5,344,008 A 9/1994 DeBlasio et al.
5,400,571 A 3/1995 Boriani et al.
5,588,281 A 12/1996 Boriani et al.
6,223,895 B1 5/2001 Bowen et al.
6,244,017 B1 * 6/2001 Focke et al. ..... 53/147
6,394,273 B1 * 5/2002 Dixon ..... 206/459.5
6,786,331 B1 * 9/2004 Zucchini ..... 206/232
2003/0121805 A1 7/2003 Chacko et al.
2005/0056554 A1 * 3/2005 Fath et al. ..... 206/271

FOREIGN PATENT DOCUMENTS

GB 2 116 949 10/1983

* cited by examiner

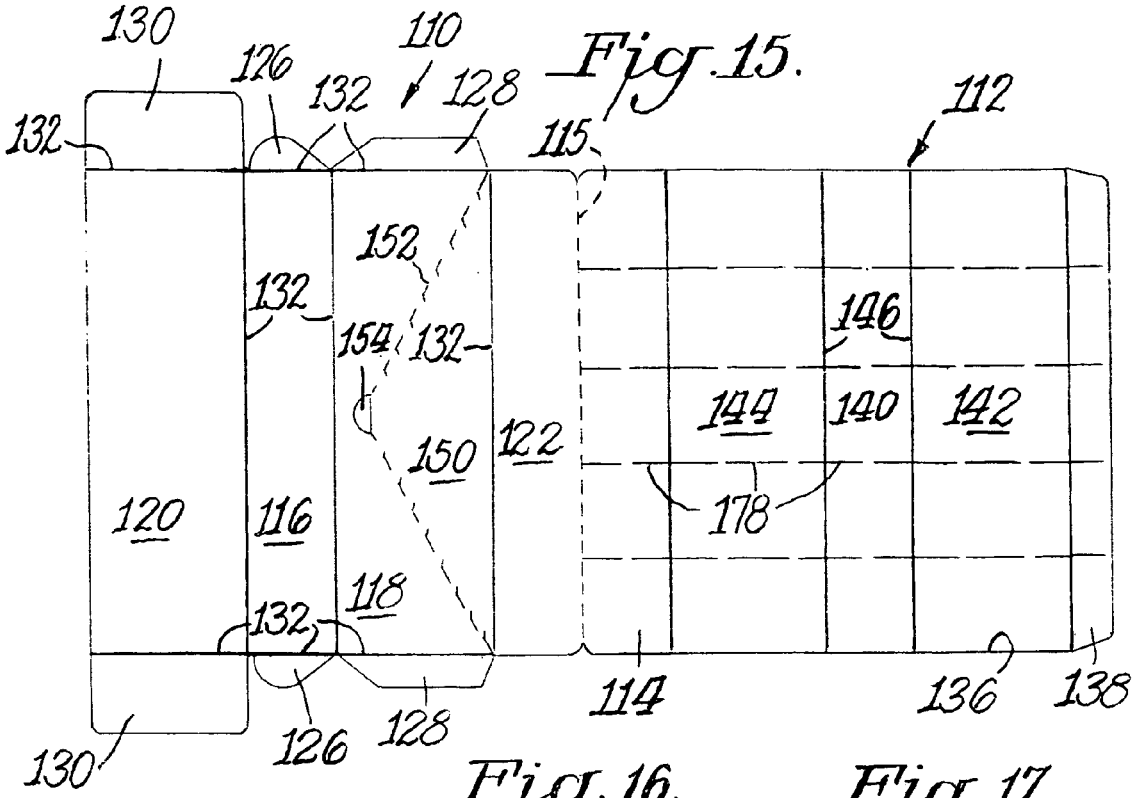
Fig. 15.
Fig. 16.
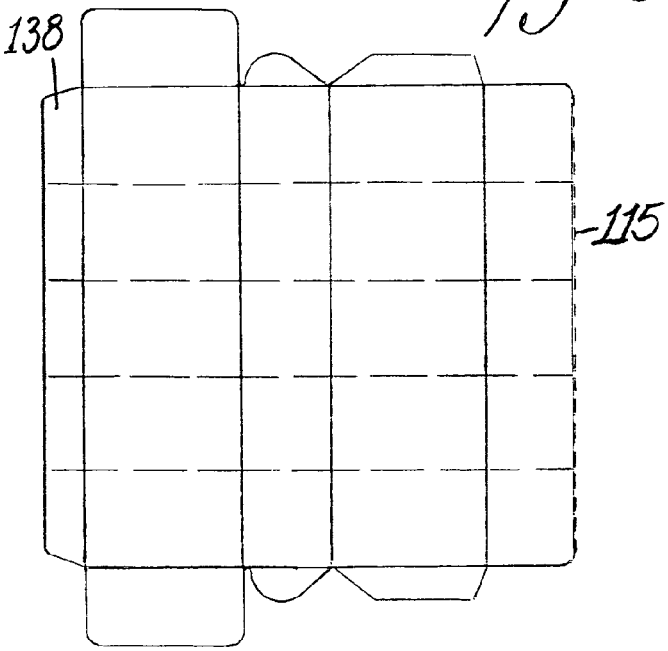
Fig. 17.
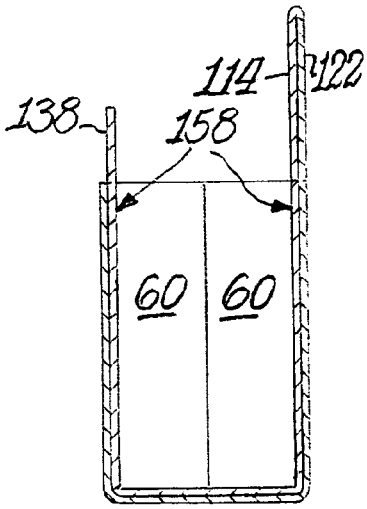

CIGARETTE CARTON WITH SEPARABLE PROMOTIONAL SHEET

CROSS REFERENCE TO RELATED APPLICATIONS

The present application claims the benefit of provisional application Ser. No. 60/533,144, filed Dec. 30, 2003 and No. 60/573,803 filed May 24, 2004, in their entirety for all useful purposes.

BACKGROUND OF THE INVENTION

The present invention relates to a cigarette carton for ten packs of cigarettes, and more particularly to a cigarette carton with an inside promotional sheet separable from the carton for use in marketing the cigarette packs.

Cigarette cartons containing ten packs of cigarettes are old in the art. Standardized procedures have been developed over the years for loading the packs in these cartons and for applying tax stamps to the individual packs before the carton is sealed. Current marketing practices include packaging sleeves that hold five, three and two packs where ten pack cartons are broken apart along predetermined lines of perforation into smaller five, three and two pack units. In these instances it is important that the standardized procedures in the industry be followed in the loading of cigarette packs in the carton and the subsequent application of tax stamps to the individual packs. Also, in many instances promotional inserts in sheet form may be incorporated into cigarette cartons for consumer use in learning more about the cigarette product, and obtaining rebates, merchandise and the like.

SUMMARY OF THE INVENTION

Accordingly, one of the objects of the present invention is a cigarette carton with a promotional sheet secured thereto for subsequent separation from the carton when marketing the cigarette packs within the carton.

Another object of the present invention is a cigarette carton with a promotional sheet in sleeve form secured thereto for subsequent separation from the carton where the sleeve is easily divided into smaller retail units holding multiple cigarette packs.

Still another object of the present invention is a cigarette carton with a promotional sheet secured thereto for subsequent separation from the carton where the sheet comprises a unitary coupon, advertisement or the like.

Another object of the present invention is a cigarette carton with a promotional sheet secured to the carton for package assembly with the carton, but which is easily separated from the carton for marketing of cigarette packs within the carton.

Another object of the present invention is a standard ten pack carton blank with a promotional sheet secured thereto within or substantially within the outline of the blank whereby the carton blank and associated promotional sheet may be assembled with standard assembly machinery using standard assembly procedures.

In accordance with the present invention, a generally flat carton blank is constructed and arranged for assembly into a carton shape holding multiple cigarette packs. The carton blank has a defined periphery in its flat condition, and an associated generally flat promotional sheet overlies the carton blank. The promotional sheet has an outer boundary within the periphery of the blank. The promotional sheet includes a flap portion and a remaining portion with the flap portion adhesively secured to the carton blank. In another embodiment, the promotional sheet has an outer boundary essentially within the periphery of the carton blank except for a narrow top closure flap. Fold lines on the carton blank and the promotional sheet facilitate assembly of the carton blank into a carton shape with the promotional sheet inside the assembled carton. Since the promotional sheet overlies and is within or substantially within the outline of the carton blank the two sheets may be assembled with standard assembly machinery using standard assembly procedures similar to those for standard ten pack cartons.

In one of many preferred embodiments of the present invention, the carton blank and the promotional sheet are integral along a fold line. The carton blank has a top closure flap and a flap portion of the promotional sheet is adhesively secured to the closure flap of the carton blank. A line of separation between the flap portion and the remaining portion of the promotional sheet enables separation of the remaining portion of the promotional sheet when the formed carton is opened and the contents thereof are removed.

In one embodiment of the present invention, the remaining portion of the promotional sheet includes fold lines for assembly into a promotional packaging sleeve having a bottom wall with opposed side walls extending upwardly therefrom. In another embodiment, the packaging sleeve has a top wall in addition to the bottom and opposed side walls. Multiple cigarette packs are positioned within the packaging sleeve inside the carton. In one embodiment of the present invention, the remaining portion of the promotional sheet includes score lines of separation so that the packaging sleeve formed therefrom with the cigarette packs therein may be separated along these score lines into smaller retail units of cigarette packs.

In an alternate embodiment of the present invention, the remaining portion of the promotional sheet may simply comprise a planar carton insert with the insert and multiple cigarette packs within the carton. The insert may be used by the consumer after the formed carton is opened and such use may include obtaining rebates, merchandise and the like or simply learning more about the cigarette product.

In one embodiment of the present invention, the promotional packaging sleeve is simultaneously separated from the carton when the carton is opened by folding back the top closure flaps of the carton. In one specific embodiment of the present invention, the formed carton with the promotional sleeve and cigarette packs therein is temporarily closed before final sealing of the carton. The carton is subsequently opened for the purpose of applying tax stamps to the cigarette packs therein. Separating the promotional packaging sleeve from the carton occurs along a line of separation between the glue flap and the remaining portion of the promotional sheet, and the actual separation is produced by bending forces applied to the line of separation when the carton is temporarily opened for the application of the tax stamps to the individual cigarette packs.

Additionally, in accordance with the present invention, a method is provided for producing a carton of cigarettes comprising the steps of providing a generally flat carton blank with an integral flat promotional sheet and adhesively securing a portion of the promotional sheet to the carton blank. The carton blank is folded into a carton shape while simultaneously folding the promotional sheet into the shape of an interior packaging sleeve. The packaging sleeve is filled with multiple cigarette packs, and the carton is sealed closed with the packaging sleeve and cigarette packs therein.

Ultimately the carton is opened and the promotional packaging sleeve with the cigarette packs therein is removed for retail distribution.

Additionally, in accordance with the present invention, an alternate method is provided for producing a carton of cigarettes comprising the steps of providing a generally flat carton blank with an integral flat promotional sheet. The carton blank is folded into a carton shape while simultaneously folding the inside promotional sheet into the shape of an interior packaging sleeve. The packaging sleeve is filled with multiple cigarette packs and sealed closed along opposed tab closure flaps with the cigarette packs therein. Ultimately the carton is separated from the promotional packaging sleeve and the sleeve with the cigarette packs therein is removed for retail distribution.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which:

FIG. 15 is a top plan view of another embodiment of a ten pack cigarette carton blank and an integral promotional sheet, according to the present invention;

FIG. 16 is a top plan view of the cigarette carton blank with the promotional sheet of FIG. 15 folded over the blank, according to the present invention;

FIG. 17 is a cross-sectional view through an assembled cigarette carton of FIGS. 15 and 16 with the promotional sheet in sleeve form and cigarette packs therein before the opposed closure flaps of the promotional sheet are glued together;

DETAILED DESCRIPTION OF THE INVENTION

Figure 1:
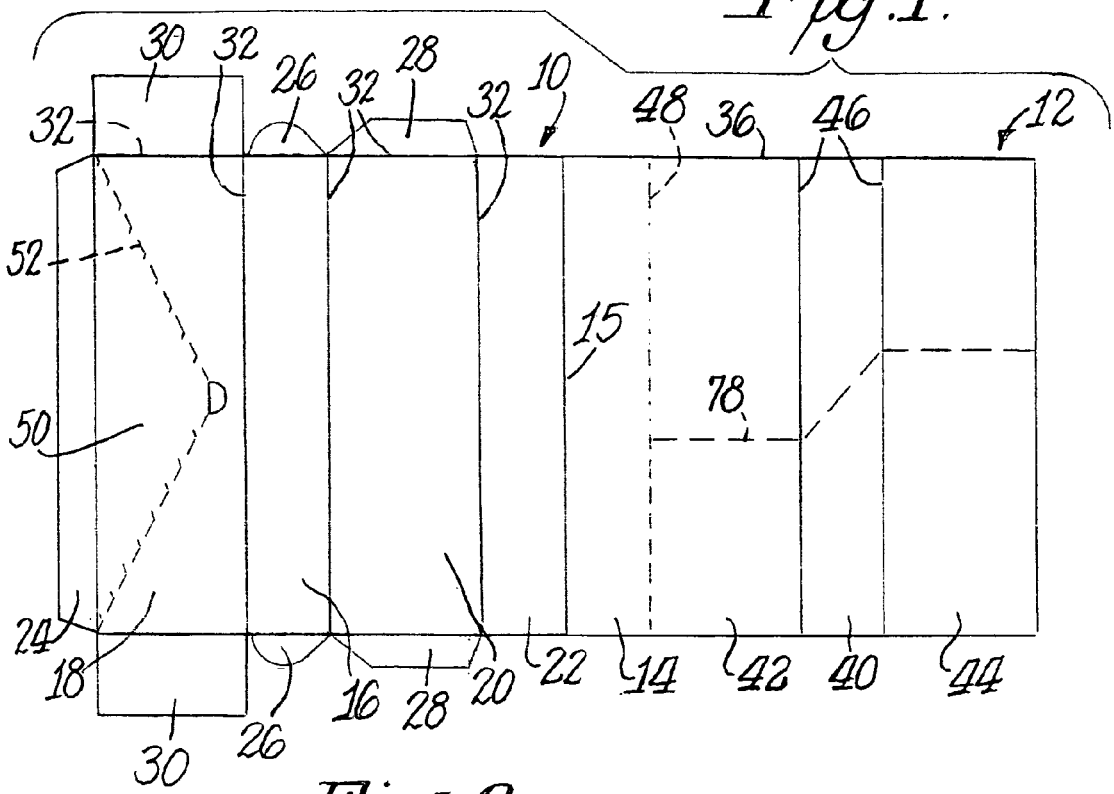
FIG. 1 is a top plan view of a ten pack cigarette carton blank and an integral promotional sheet, according to the present invention.

Referring in more particularity to the drawings, FIG. 1 shows a ten pack cigarette carton blank 10 for assembly into a traditional carton shape holding ten cigarette packs of five rows with two cigarette packs in each row. A promotional sheet/carton insert portion 12 is integrally associated with the carton blank 10, and the promotional sheet has a flap portion 14 integral with the carton blank along fold line 15 as shown in FIG. 1 and explained more fully below.

Figure 3:
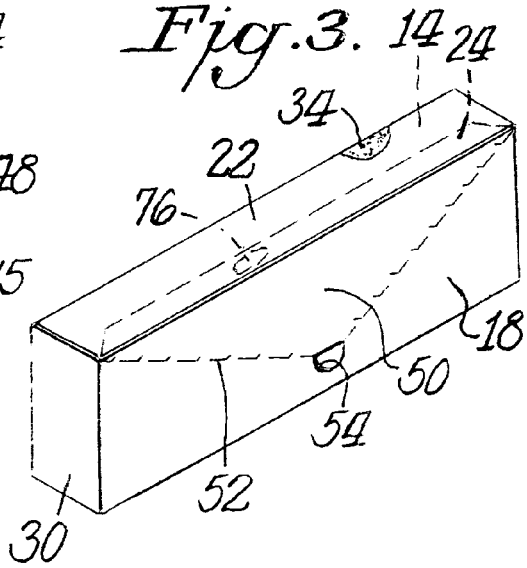
FIG. 3 is a perspective view of an assembled cigarette carton with the promotional sheet in sleeve form inside the carton before removal of the sleeve and the cigarette packs therein.

Fundamentally, the carton blank 10 comprises a bottom wall 16 with a front side wall 18 and a back side wall 20. An outer top wall 22 is adjacent the back side wall 20 and an inner top wall 24 is adjacent front side wall 18. The ends of the carton blank 10 comprise bottom end wall flaps 26 adjacent the ends of bottom wall 16. Additionally, inner end walls 28 are adjacent the ends of the back side wall 20 while outer end walls 30 are adjacent the ends of the front side wall 18. Fold lines 32 are provided between the wall panels of the carton blank to facilitate folding the blank into a traditional carton shape, such as shown in FIG. 3.

Figure 2:
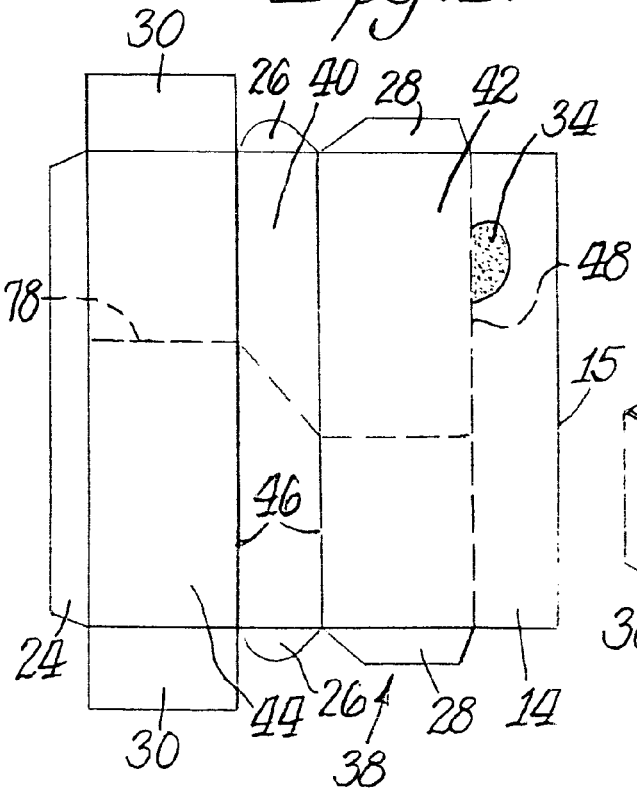
FIG. 2 is a top plan view of the cigarette carton blank with the promotional sheet of FIG. 1 folded over the blank and adhesively secured thereto, according to the present invention.

Flap portion 14 of the promotional sheet 12 is secured by adhesive 34 to the outer top wall 22 of the carton blank 10 after the promotional sheet is folded along fold line 15 over the carton blank. Basically, the promotional sheet 12 has an outer boundary or periphery 36 that lies within the boundary or periphery of the carton blank 10. This enables assembly of the carton blank and promotional sheet 12 to be folded into carton shape utilizing standard assembly machinery and standard procedures. FIG. 2 shows the promotional sheet 12 folded over and secured to the carton blank by adhesive 34. The fold line 15 insures that the sheet and blank are properly positioned relative to one another. Alternatively, the sheet and blank may comprise separate pieces, but proper alignment then requires more precise handling.

The promotional sheet 12 shown in FIGS. 1 and 2 includes a remaining portion 38 in addition to the flap portion 14. Such remaining portion comprises a bottom wall 40 and upwardly extending side walls 42, 44. Fold lines 46 extend between the bottom wall 40 and the upstanding side walls 42, 44 to facilitate formation of the promotional sheet into the form of a sleeve having a U-shaped cross section. The fold lines 42, 44 overlay the fold lines 32 adjacent the bottom wall 16 of the carton blank 10. Accordingly, when the carton blank is assembled into the form of a carton the promotional sheet is simultaneously folded into the form of a packaging sleeve.

As shown in FIGS. 1 and 2, a perforated line of separation 48 extends between the flap portion 14 of the promotional sheet 12 and the remaining portion 38 of the sheet. The line of separation enables the remaining packaging sleeve portion of the promotional sheet to be separated from the flap 14 and the outer top wall 22 of the carton blank 10 to which flap 14 is secured by adhesive 34. The mechanics of such removal is explained more fully below.

The front side wall 18 of the carton blank 10 includes a removal flap 50 for separation from the remaining portion of the front side wall along a perforated line of separation 52. As shown in FIG. 3, insertion of a finger into an opening 54 in front side wall 18 enables upward movement of the finger to release flap 50 from the remainder of the front side wall 18 along the perforated line 52.

Figure 4:
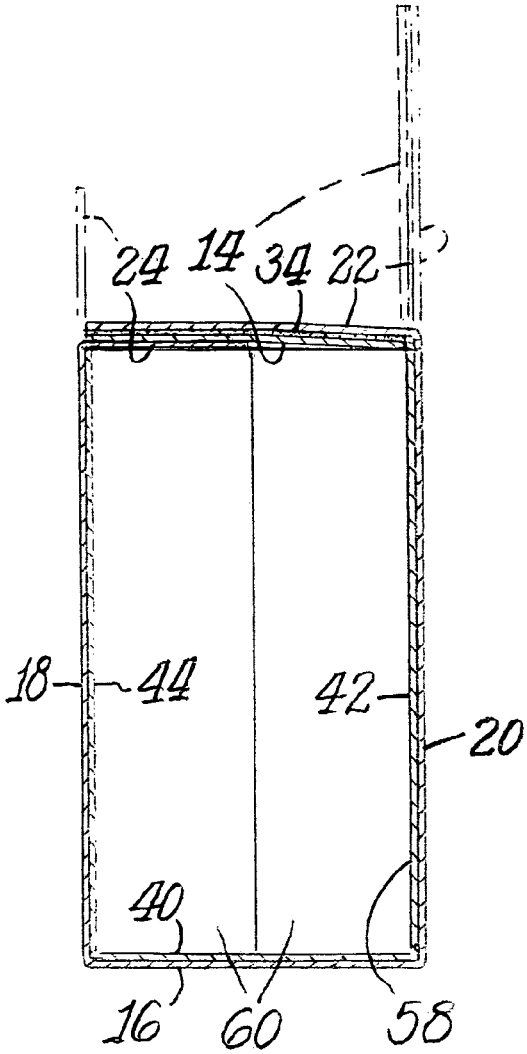
FIG. 4 is a cross-sectional view through an assembled cigarette carton with the promotional sheet in sleeve form and cigarette packs therein before the carton is temporarily opened for application of tax stamps to the individual cigarette packs and before the closure flaps of the carton are glued in place.
Figure 5:
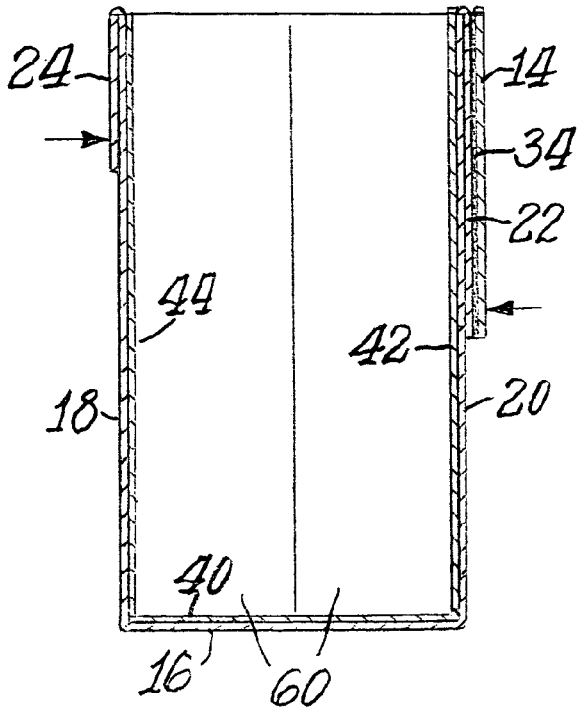
FIG. 5 is a cross-sectional view similar to FIG. 4, but illustrating temporarily opening the assembled carton for applying tax stamps to the cigarette packs therein.
Figure 6:
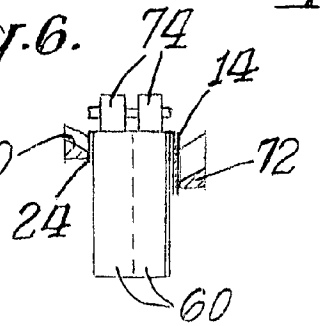
FIG. 6 is a cross sectional view similar to FIG. 5 with the carton temporarily opened for application of tax stamps to the individual cigarette packs and with the promotional sheet in sleeve form broken away from the carton along a perforated line of separation by action of the carton flap being bent open.

Turning now to FIGS. 4, 5 and 6, the carton blank 10 is assembled into the form of a standard carton and the inside promotional sheet 12 is formed into a U-shaped packaging sleeve 58 into which cigarette packs 60 are inserted. The inner top wall 24 of the carton blank is inwardly folded while the outer top wall 22 is inwardly folded over the inner top wall to thereby form the top of the carton. The carton is not secured in its closed position, but instead the top walls 22, 24 loosely form the top of the carton, and this position is best shown in FIG. 4. Subsequently, at a downstream location, the carton is temporarily opened by folding the outer top wall 22 with the flap 14 of the promotional sheet 12 glued thereto against the back side wall 20 of the blank 10. The inner top wall 24 is similarly folded against the outside of the front side wall 18. Such positioning is shown best in FIG. 5. It is significant that the flap portion 14 of the promotional sheet 12 is separated from the remaining portion 38 of the promotional sheet by the bending forces applied to the line of separation 48 when the outer top wall 22 of the blank 10 and flap portion 14 of the promotional sheet 12 are moved to their fully opened positions shown in FIG. 5.

Normally cigarette cartons are temporarily opened for the application of tax stamps to the individual packs 60 within the carton. Such an arrangement is shown in FIG. 6 where folding plows 70, 72 function to fold the top walls of the carton against the side walls. This enables tax stamp machinery 74 to apply required tax stamps to the individual packs 60 within the carton. In the case of the present invention, this folding action also produces the necessary bending forces to break the line of separation 48 and thereby separate the packaging sleeve 58 of the promotional sheet 12 from the glue flap portion 14. Following the application of the tax stamps, the inner and outer top walls of the carton blank 10 are closed and the outer top wall 22 and flap 14 are secured to the inner top wall 24 by adhesive 76.

Figure 7:
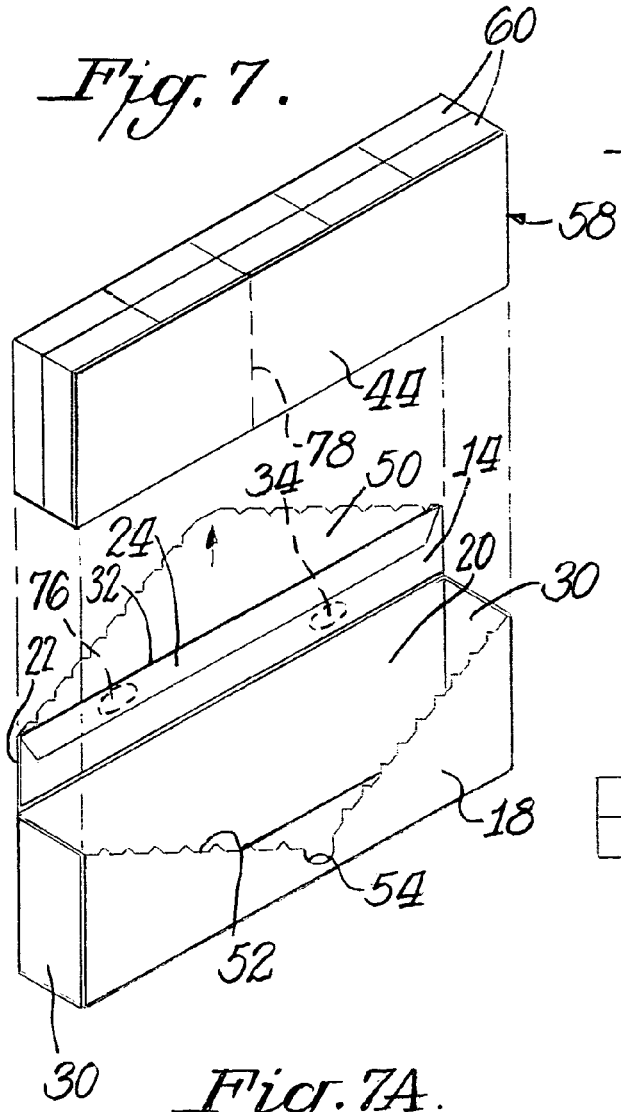
FIG. 7 is an exploded perspective view of an assembled cigarette carton after opening thereof with the promotional sheet in sleeve form removed from the carton and holding packs of cigarettes for subsequent separation of the sleeve into two-five pack retail units.

FIG. 7 illustrates the removal of the promotional packaging sleeve 58 from the carton formed from blank 10. Upward force applied to the flap 50 of the front side wall 18 breaks the line of separation 52 which separates the flap 50 from the front side wall 18. Continued upward movement of the flap 50 to the position shown in FIG. 7 removes the inner top wall 24 connected to the flap 50 as well as the outer top wall 22 secured to the inner top wall 24 via flap 14 by adhesive 76. When the flap 50 is in the open position as shown in FIG. 7, the promotional packaging sleeve 58 with cigarette packs 60 therein may be removed from the carton since the sleeve has already been separated from the glue flap 14 along the line of separation 48. Such separation was the result of the bending forces applied to flap portion 14 when the carton was opened for application of the tax stamps to the cigarette packs 60.

Figure 7A:
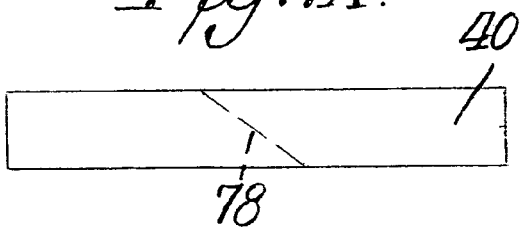
FIG. 7A is a bottom plan view of the promotional sleeve of FIG. 7.

The promotional sheet shown in sleeve form 58 in FIG. 7 includes lines of separation 78 for separating the sleeve and the cigarette packs into two five pack retail units. Such lines of separation are also shown in FIG. 7A. As explained more fully below, appropriately positioned adhesive in the form of glue dots applied to the inside surfaces of the promotional sheet function to hold the cigarette packs and promotional sheet together as a unit.

Figure 8:
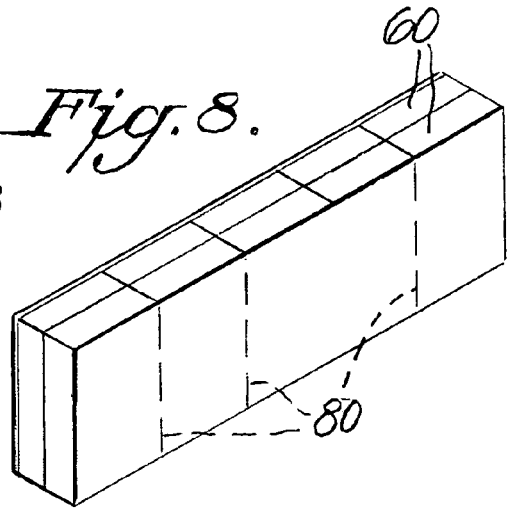
FIG. 8 is a perspective view of an assembled promotional sheet in sleeve form holding packs of cigarettes after separation from the carton with the promotional sheet perforated for separation into three-three pack retail units and a single cigarette pack.
Figure 8A:
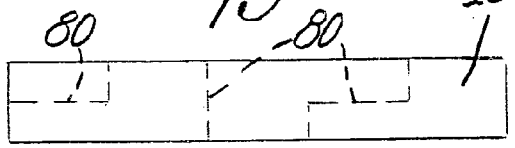
FIG. 8A is a bottom plan view of the promotional sleeve of FIG. 8.

FIGS. 8 and 8A show a modified promotional packaging sleeve where lines of separation 80 are provided for separating the sleeve into smaller retail units comprising three packages of three cigarette packs each and a single pack.

Figure 9:
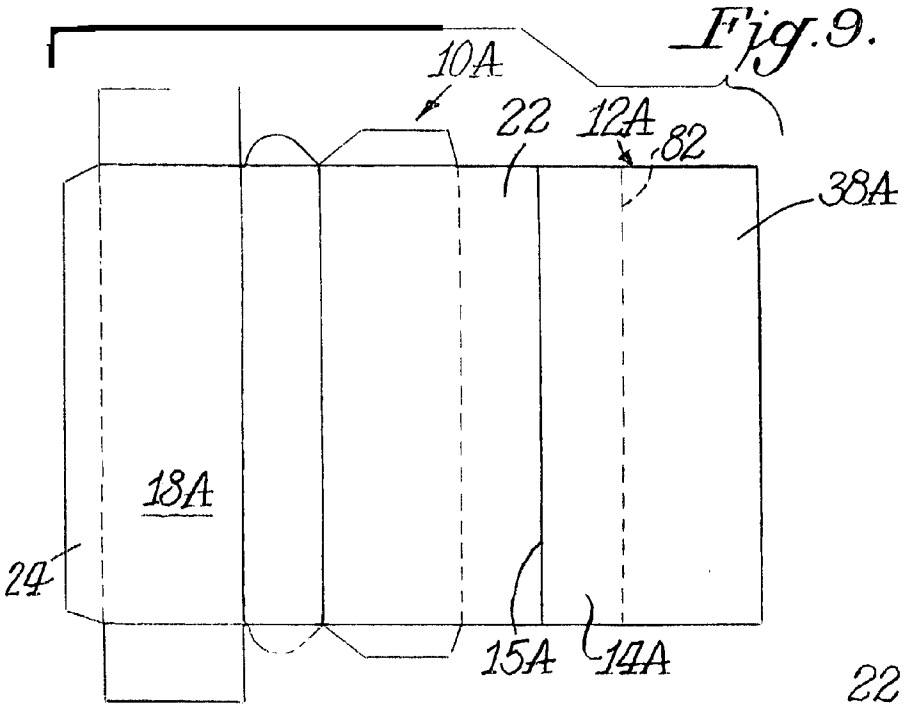
FIG. 9 is a top plan view of a cigarette carton blank and another embodiment of an integral promotional sheet, according to the present invention.

FIG. 9 shows an alternate embodiment of the present invention where a promotional sheet 12A comprises a glue flap 14A and a remaining portion 38A in the form of a planar carton insert. Instead of a perforated line of separation between the glue flap 14A and the planar carton insert, these portions may be separated by a fold line 82 or a line of perforations that does not separate upon application of bending forces. The carton blank 10A also shown in FIG. 9 is similar to the blank shown in FIGS. 1 and 2 and similar reference characters are used to identify similar parts. The only major difference is that the blank 10A of FIG. 9 does not include a flap on front wall 18A. The carton blank 10A is integral with promotional sheet 12A along fold line 15A.

Figure 10:
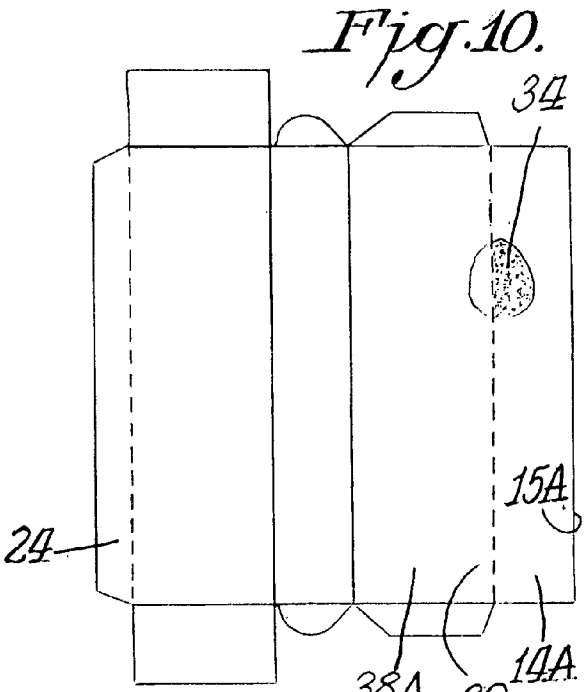
FIG. 10 is a top plan view of the cigarette carton blank with the promotional sheet of FIG. 9 folded over the blank and glued thereto, according to the present invention.

FIG. 10 shows the carton blank 10A with the promotional sheet 12A folded along line 15A and overlying the blank. Flap portion 14A of the promotional sheet is secured to the outer top wall 22 of blank 10A by adhesive 34.

Figure 11:
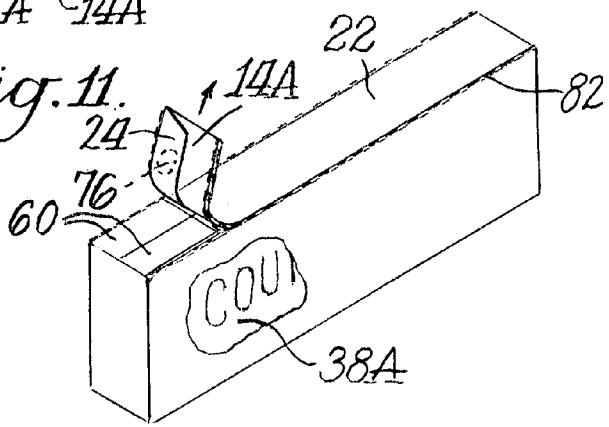
FIG. 11 is a perspective view of an assembled carton and promotional sheet of FIG. 10 being opened with the promotional sheet simultaneously separated from the carton, according to the present invention.

Following assembly of the carton blank 10A into the shape of a carton, the carton is simply loaded with cigarette packs 60 and the outer top wall 22 and associated glue flap 14A are secured to the inner top wall 24 by adhesive 76 after application of tax stamps to the packs to thereby seal the carton closed. Opening of the carton 10A is best shown in FIG. 11 where the top walls 22, 24 of the carton are simply removed together with the glue flap 14A of the promotional sheet. The contents of the carton comprising the cigarette packs 60 and the planar carton insert 38A are then easily removed from the carton.

Figure 12:
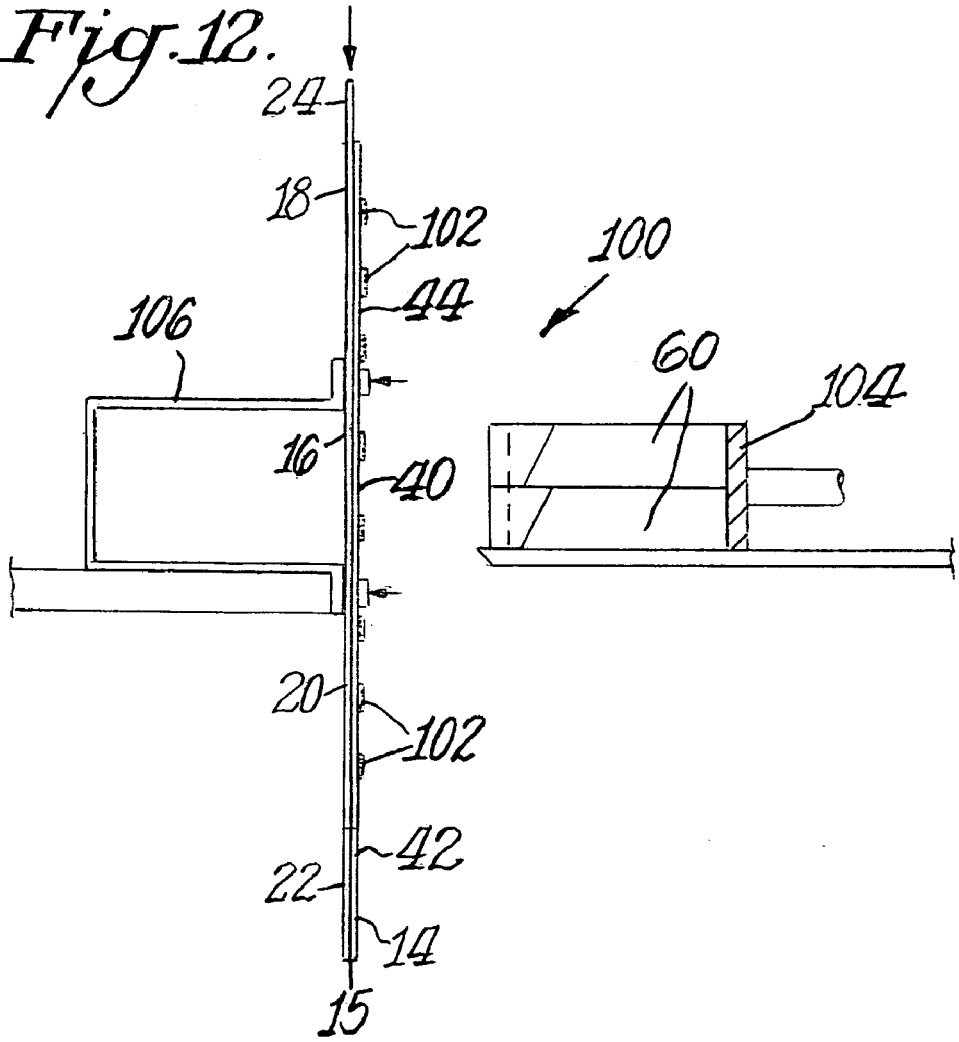
FIG. 12 is a diagrammatic side elevational view illustrating placement of cigarette packs into the carton blank and the inside promotional sheet.
Figure 14:
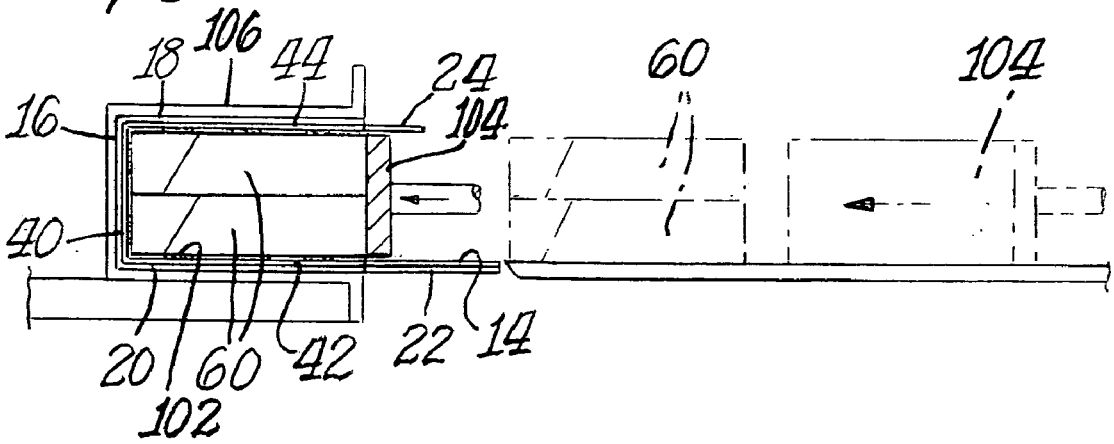
FIG. 14 is a view similar to FIG. 12 with the carton blank partially folded into a carton shape and the cigarette packs inside.
Figure 13:
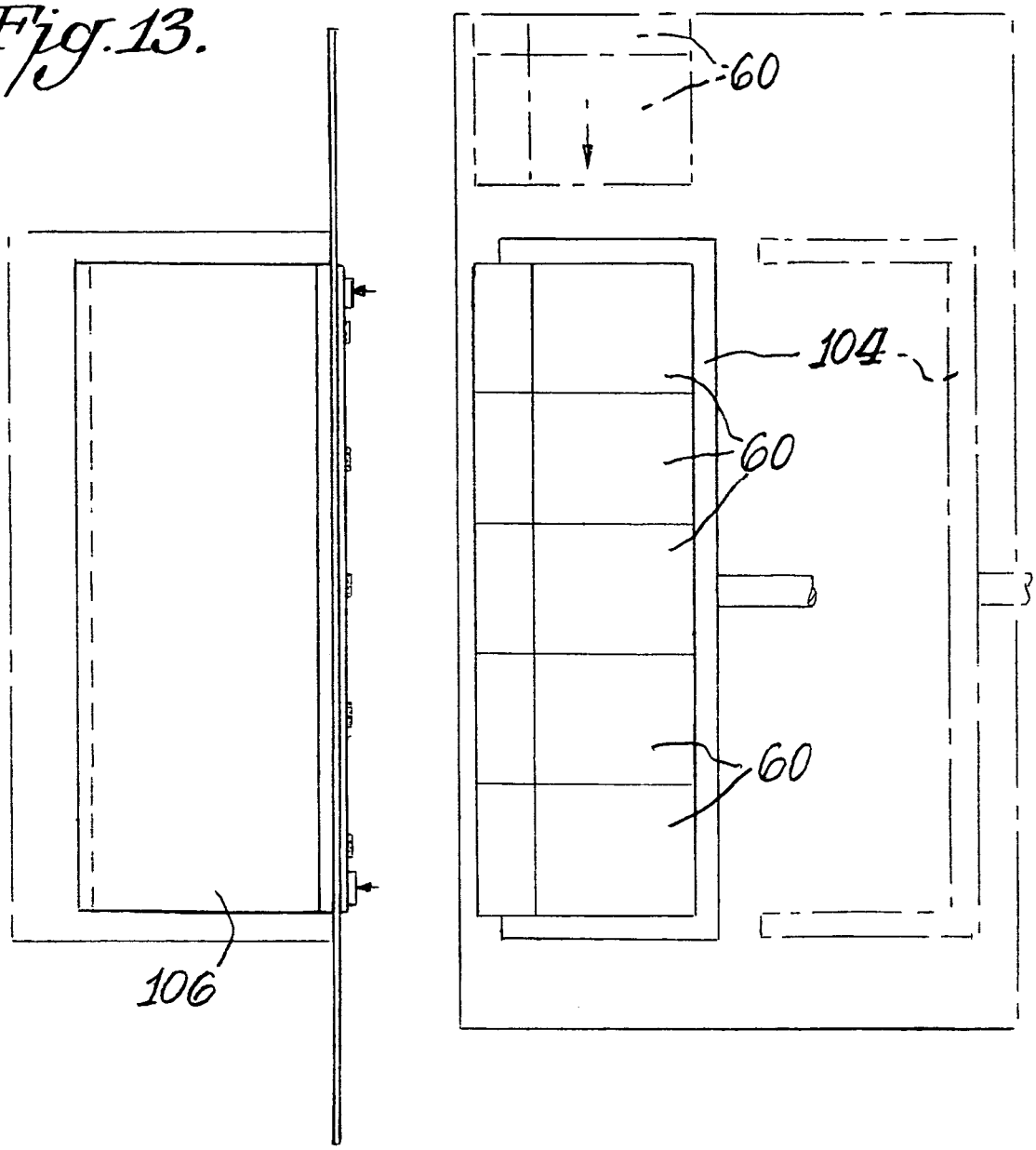
FIG. 13 is a top plan view of the arrangement shown in FIG. 12.

FIGS. 12–14 diagrammatically illustrate filling and forming the carton blank 10, 10A and promotional sheet 12, 12A. In this regard, the carton blank with promotion sheet secured thereto is transported to a pack filling and carton forming station 100. Adhesive in the form of glue dots 102 are appropriately positioned on the outside of the promotional sheet depending upon the desired packaging of the cigarette packs. For example, if a standard ten pack retail unit is desired glue dots 102 are applied to the bottom wall 40 and side walls 42, 44 of sheet 12 in order to secure all ten packs in place.

Cigarette packs 60 are positioned as a block of ten packs and a pusher mechanism 104 then pushes the block of ten packs against the bottom wall 40 of the promotional sheet. Continued movement of the pusher mechanism forces the carton blank and promotional sheet into a former 106 to thereby fold the walls into a carton shape. Subsequently, end flaps 26, 28, 30 of the carton blank are glued closed and the top flaps are folded over for later opening when tax stamps are applied to the packs.

Preferably, the promotional sheet/carton insert portion 12 and the outer carton blank portion 10 are integrally formed or cut from a single sheet of stock board material, which portions 10, 12 are then folded into a superposing relation along the fold line 15, as shown in FIGS. 1 and 2. Preferably, the stock board material is that which is typically used in forming cigarette cartons, although other known packaging materials could be used.

Typically, stock board material has a finished side and a less finished or unfinished side, the finished side being the preferred side for printing and/or presentation to a customer. Preferably, the surface of the promotional sheet/carton insert portion 12 that is presented to the customer upon removal of the insert structure from the remainder or outer portion of the carton comprises the finished side of the stock board material. In such case, the exterior or viewable surface of the outer carton blank portion comprises the less finished side of the stock board material. Decorative printing can be minimized on the exterior viewable surface of the outer carton blank portion so as to avoid waste. The outer carton blank portion enhances protection of the printed promotional sheet/carton insert during shipping, stocking and handling of product.

In the alternative, the promotional sheet/carton insert and the exterior carton blank portion could be formed separately and possibly of different materials and joined together in a superposed relation as shown in FIG. 2.

FIG. 15 shows another ten pack cigarette carton blank 110 for assembly into a carton shape holding ten cigarette packs of five rows with two cigarette packs in each row. A promotional sheet/carton insert portion 112 is integrally associated with the carton blank 110, and the promotional sheet has a top first closure flap portion 114 integral with the carton blank along fold line 115 as shown in FIG. 15 and explained more fully below.

Fundamentally, the carton blank 110 comprises a bottom wall 116 with a front side wall 118 and a back side wall 120. A top wall 122 is adjacent the back side wall 120. The ends of the carton blank 110 comprise bottom end wall flaps 126 adjacent the ends of bottom wall 116. Additionally, inner end walls 128 are adjacent the ends of the front side wall 118 while outer end walls 130 are adjacent the ends of the back side wall 120. Fold lines 132 are provided between the wall panels of the carton blank to facilitate folding the blank into a traditional carton shape, such as shown in FIGS. 17–20.

The promotional sheet 112 is folded along fold line 115 over the carton blank, as shown in FIG. 16. Basically, the promotional sheet 112 has an outer boundary or periphery 136 that lies within the boundary or periphery of the carton blank 110, except for a relatively narrow second closure flap portion 138 of the promotional sheet. This enables assembly of the carton blank and promotional sheet 112 to be folded into carton shape utilizing standard assembly machinery and standard procedures for ten pack cigarette cartons. The fold line 115 insures that the sheet and blank are properly positioned relative to one another. Alternatively, the sheet and blank may comprise separate pieces, but proper alignment then requires more precise handling.

The promotional sheet 112 shown in FIGS. 15 and 16 comprises a bottom wall 140 and upwardly extending side walls 142, 144. Fold lines 46 extend between the bottom wall 140 and the upstanding side walls 142, 144 to facilitate formation of the promotional sheet into the form of a sleeve having a U-shaped cross section. The fold lines 146 overlay the fold lines 132 adjacent the bottom wall 116 of the carton blank 110. Accordingly, when the carton blank is assembled into the form of a carton the promotional sheet is simultaneously folded into the form of a packaging sleeve.

As shown in FIGS. 15 and 16, fold line 115 is also a line of separation between the promotional sheet 112 and the carton 110. The line of separation enables the packaging sleeve portion to be separated from the outer top wall 122 of the carton, as explained more fully below.

Figure 20:
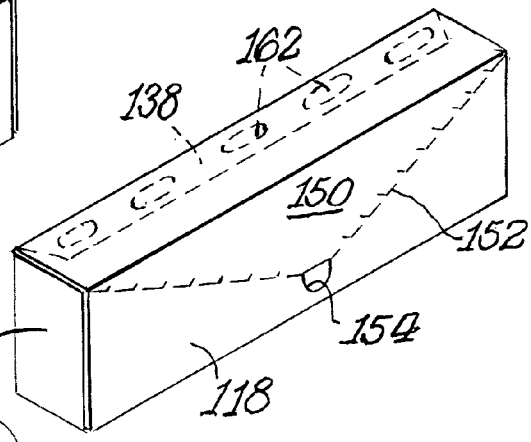
FIG. 20 is a perspective view similar to FIG. 19 showing the other side of the outer carton.

The front side wall 118 of the carton blank 110 includes a removal flap 150 for separation from the remaining portion of the front side wall along a perforated line of separation 152. As shown in FIG. 20, insertion of a finger into an opening 154 in front side wall 18 enables upward movement of the finger to release flap 150 from the remainder of the front side wall 118 along the perforated line 152.

Figure 18:
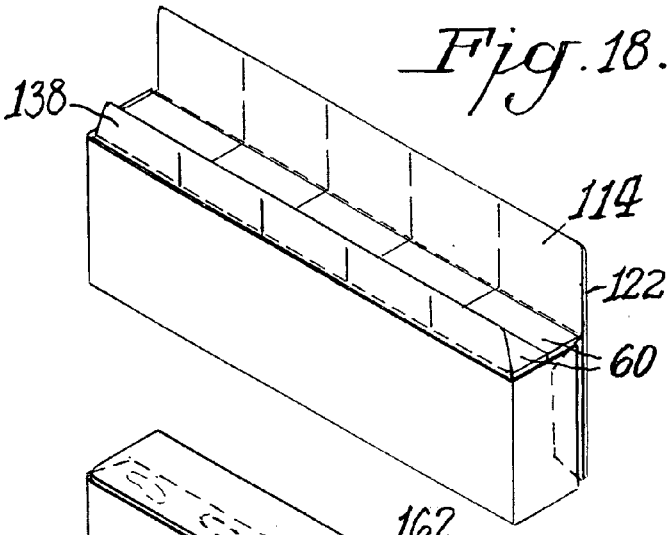
FIG. 18 is a perspective view of an assembled cigarette carton of FIGS. 15 and 16 with the promotional sheet in sleeve form inside the carton before the opposed closure flaps of the promotional sheet are glued together.
Figure 19:
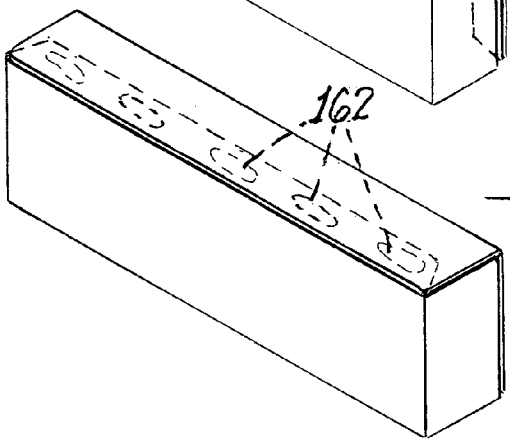
FIG. 19 is a perspective view similar to FIG. 18, but illustrating the opposed closure flaps of the promotional sheet secured together.

Turning now to FIGS. 17, 18 and 19, the carton blank 110 is assembled into the form of a standard carton and the inside promotional sheet 112 is formed into a U-shaped packaging sleeve 158 into which cigarette packs 60 are inserted. The top wall 122 of the carton blank is inwardly folded to thereby form the top of the carton. The carton is not secured in its closed position, but instead the top wall 122 loosely forms the top of the carton. Subsequently, at a downstream location, the carton is temporarily opened by folding the top wall 122 with the closure flap 114 of the promotional sheet 112 adjacent thereto against the front side wall 118 of the blank 110.

Normally cigarette cartons are temporarily opened for the application of tax stamps to the individual packs 60 within the carton. This enables tax stamp machinery (such as shown in FIG. 6) to apply required tax stamps to the individual packs 60 within the carton. Following the application of the tax stamps, the narrow top closure flap 138 is inwardly folded and the opposite top closure flap 14 also is inwardly folded over flap 138, and flaps are secured together by adhesive 162, as shown in FIGS. 18 and 19.

Figure 21:
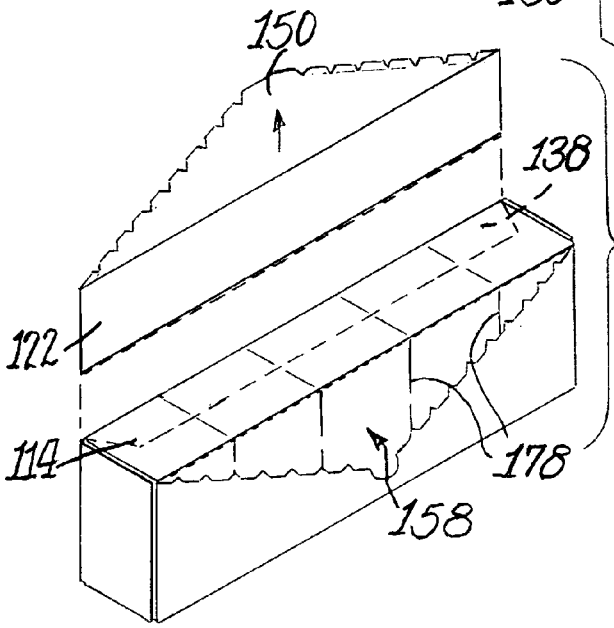
FIG. 21 is an exploded perspective view of an assembled cigarette carton of FIGS. 15 and 16 after opening thereof with the promotional sheet in sleeve form inside the carton.
Figure 22:
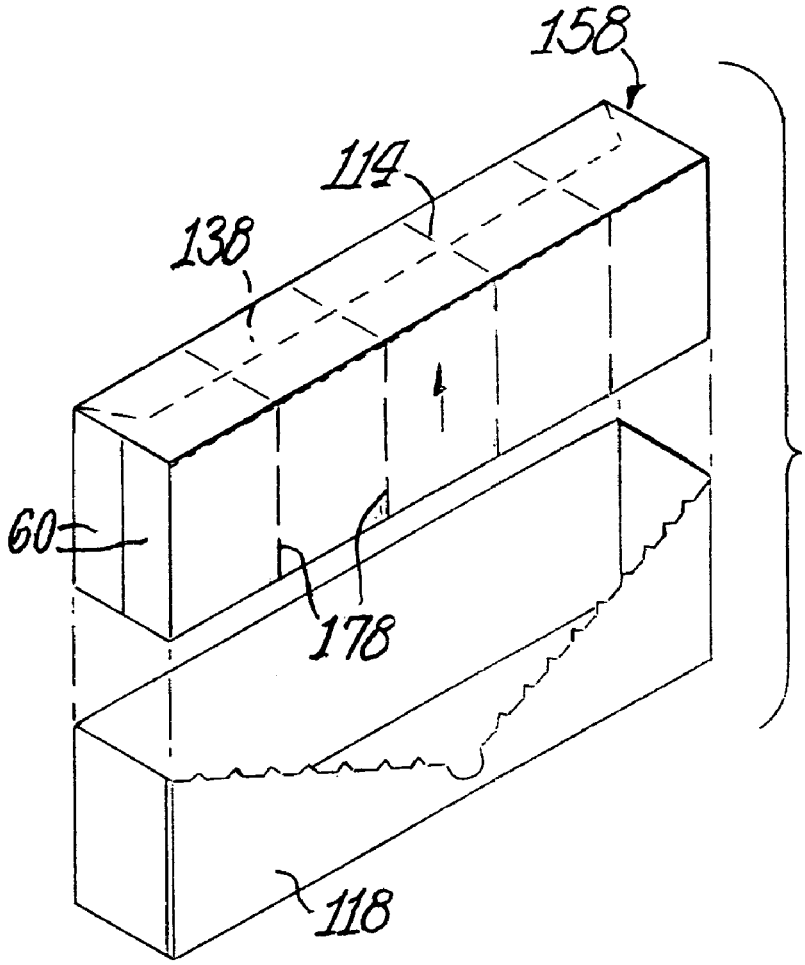
FIG. 22 is an exploded perspective view similar to FIG. 21 with the promotional sheet in sleeve form being removed from the open carton.

FIGS. 21 and 22 illustrate the removal of the promotional packaging sleeve 158 from the carton formed from blank 110. Upward force applied to the flap 150 of the front side wall 18 breaks the line of separation 152 which separates the flap 150 from the front side wall 18. Continued upward movement of the flap 150 to the position shown in FIG. 21 removes the top wall 122 of the carton which is connected to the flap 50. Ultimately, the flap 150 and the top wall 122 of the carton are separated from the remaining portions of the carton by tearing along the line of separation 15. The promotional packaging sleeve 158 with cigarette packs 60 therein then may be removed from the carton.

The promotional sheet shown in sleeve form 158 in FIG. 21 includes lines of separation 178 for separating the sleeve and the cigarette packs into five two pack retail units. However, other lines of separation may also be used so as to form the cigarette packs into two five pack retail units or three three pack units and a single unit, for example.

Preferably, the promotional sheet/carton insert portion 12 and the outer carton blank portion 10 are integrally formed or cut from a single sheet of stock board material, which portions 110, 112 are then folded into a superposing relation along the fold line 115, as shown in FIGS. 15 and 16. Preferably, the stock board material is that which is typically used in forming cigarette cartons, although other known packaging materials could be used such as described above.

In the alternative, the promotional sheet/carton insert and the exterior carton blank portion could be formed separately and possibly of different materials and joined together in a superposed relation as shown in FIG. 16.

Formation and loading of cigarette packs 60 into carton 110 and promotional sheet 112 may be similar to the descriptions above in connection with FIGS. 12–14. Also, glue dot may be used to releasable secure the packs 60 in place.

It should be understood that the above detailed description while indicating preferred embodiments of the invention are given by way of illustration only since various changes and modifications within the spirit and scope of the invention will become apparent to those skilled in the art from the detailed description.

What is claimed is:

1. A generally flat carton blank for assembly into a carton holding multiple cigarette packs, the blank having a defined periphery, and a generally flat promotional sheet overlying the carton blank having an outer boundary within the periphery of the blank, the promotional sheet including a flap portion and a remaining portion with the flap portion adhesively secured to the carton blank, and fold lines on the carton blank and the promotional sheet to facilitate assembly of the carton blank into a carton with the promotional sheet inside the assembled carton, the carton blank including a closure flap and the flap portion of the promotional sheet being adhesively secured to the closure flap, a line of separation between the flap portion and the remaining portion of the promotional sheet, the remaining portion of the promotional sheet including fold lines for assembly into a promotional packaging sleeve having a bottom wall with opposed side walls extending upwardly therefrom, and wherein the remaining portion of the promotional sheet includes score lines of separation whereby the packaging sleeve formed from the promotional sheet with the cigarette packs therein is separable along the score lines into smaller retail units of the cigarette packs and individual promotional sheets.

2. A carton blank and promotional sheet as in claim 1 wherein the blank and sheet are integral with one another along a fold line and formed from a single piece of stock material.

* * * * *